US009370859B2

(12) United States Patent
Kosuge et al.

(10) Patent No.: US 9,370,859 B2
(45) Date of Patent: Jun. 21, 2016

(54) GAS COMBUSTION TYPE DRIVING TOOL

(75) Inventors: Makoto Kosuge, Tokyo (JP); Yasushi Yokochi, Tokyo (JP); Takamichi Hoshino, Tokyo (JP)

(73) Assignee: MAX CO., LTD., Tokyo (JP)

( * ) Notice: Subject to any disclaimer, the term of this patent is extended or adjusted under 35 U.S.C. 154(b) by 785 days.

(21) Appl. No.: 13/372,958

(22) Filed: Feb. 14, 2012

(65) Prior Publication Data

US 2012/0211539 A1 Aug. 23, 2012

(30) Foreign Application Priority Data

Feb. 22, 2011 (JP) ..... 2011-036184

(51) Int. Cl.
*B25C 1/08* (2006.01)

(52) U.S. Cl.
CPC ..... *B25C 1/08* (2013.01)

(58) Field of Classification Search
CPC ..... B25C 1/047; B25C 1/008; B25C 1/18; B25C 1/08; B25C 5/025
USPC ..... 227/9, 10, 8, 130, 156; 123/465 C, 48 A, 123/46 SC, 46 R, 46 H; 60/632, 633; 239/585.1
See application file for complete search history.

(56) References Cited

U.S. PATENT DOCUMENTS

| | | | | |
|---|---|---|---|---|
| 4,403,722 | A | 9/1983 | Nikolich | |
| 4,739,915 | A * | 4/1988 | Cotta | 227/10 |
| 6,145,724 | A | 11/2000 | Shkolnikov et al. | |
| 6,464,018 | B1 | 10/2002 | Uhl | |
| 2003/0116605 | A1 | 6/2003 | Rosenbaum | |
| 2007/0074706 | A1 | 4/2007 | Wagdy et al. | |
| 2008/0000451 | A1 * | 1/2008 | Shea et al. | 123/46 SC |

FOREIGN PATENT DOCUMENTS

| | | | |
|---|---|---|---|
| CN | 1431083 | A | 7/2003 |
| CN | 101304844 | A | 11/2008 |
| EP | 0316468 | A2 | 5/1989 |
| EP | 1 977 864 | A1 | 10/2008 |
| FR | 2 833 199 | A1 | 6/2003 |
| JP | A-H07-108406 | | 4/1995 |
| JP | A-2001-191270 | | 7/2001 |

* cited by examiner

*Primary Examiner* — Gloria R Weeks
*Assistant Examiner* — Chinyere Rushing-Tucker
(74) *Attorney, Agent, or Firm* — Drinker Biddle & Reath LLP

(57) ABSTRACT

A gas combustion type driving tool is provided with a fuel container storing portion, a lid that covers an opening of the fuel container storing portion, a connecting section which is formed in the fuel container storing portion and to which a nozzle of a fuel container is connected; and a cover member that covers the connecting section. The fuel container storing portion is adapted so that the fuel container stored within the fuel container storing portion is attachable and detachable by opening the lid. The connecting section is adapted to be exposed to an outside of the tool by opening the cover member.

2 Claims, 9 Drawing Sheets

GAS COMBUSTION TYPE DRIVING TOOL

BACKGROUND OF THE INVENTION

1. Field of the Invention

The present invention relates to a gas combustion type driving tool.

2. Related Art

In a gas combustion type driving tool, a fuel container such as a gas can filled with a liquefied fuel gas is mounted within the tool, the flammable gas supplied from the fuel container is injected into a closed combustion chamber, a mixed gas constituted of the flammable gas and an air within the combustion chamber is generated, and a fastening member is driven into a work-piece using combustion pressure generated when the mixed gas is ignited.

The fuel container is stored in a fuel container storing portion formed within a housing, and the fuel container is attachable and detachable with respect to a main body of the tool. The fuel container is replaced when the fuel in the fuel container is used up.

The fuel container storing portion includes a connecting section to which a nozzle of the fuel container is connected. The fuel in the fuel container is supplied through this connecting portion.

Conventionally, the connecting section is structured such that it cannot be cleaned or replaced unless the driving tool is disassembled. Thus, a maintenance of the connecting section is difficult for a user.

US2007/0074706 discloses a tool in which the connecting section is formed in a cover member for covering the fuel container storing portion and the nozzle of the fuel container can be connected to this connecting section.

In the tool of US2007/0074706, since the connecting section is formed in the cover member, when the cover member is opened, the connecting section is exposed and thus the connecting section can be easily cleaned or replaced. However, although the cleaning or replacement of the connecting section is easy, the connecting section is always exposed whenever the fuel container is mounted into or removed from the driving tool. Therefore, there is found a disadvantage that a foreign substance such as dust is easy to stick to the connecting section. Also, when the cover member is opened and closed, a pipe line communicating with the connecting section is caused to move. This frequently applies a load to the pipe line, resulting in the degraded durability.

SUMMARY OF THE INVENTION

One or more embodiments and modifications thereof provide a gas combustion type driving tool structured such that a connecting section for connecting a fuel container can be easily cleaned or replaced and a foreign substance is hard to stick to the connecting section.

DETAILED DESCRIPTION OF THE EMBODIMENTS

Description will be given below of an embodiment and modifications thereof with reference to the accompanying drawings.

The embodiment and the modifications described herein are not intended to limit the invention but only to exemplify the invention, and all features or combinations of the features of the embodiment and the modifications are not always essential to the invention.

Figure 1:
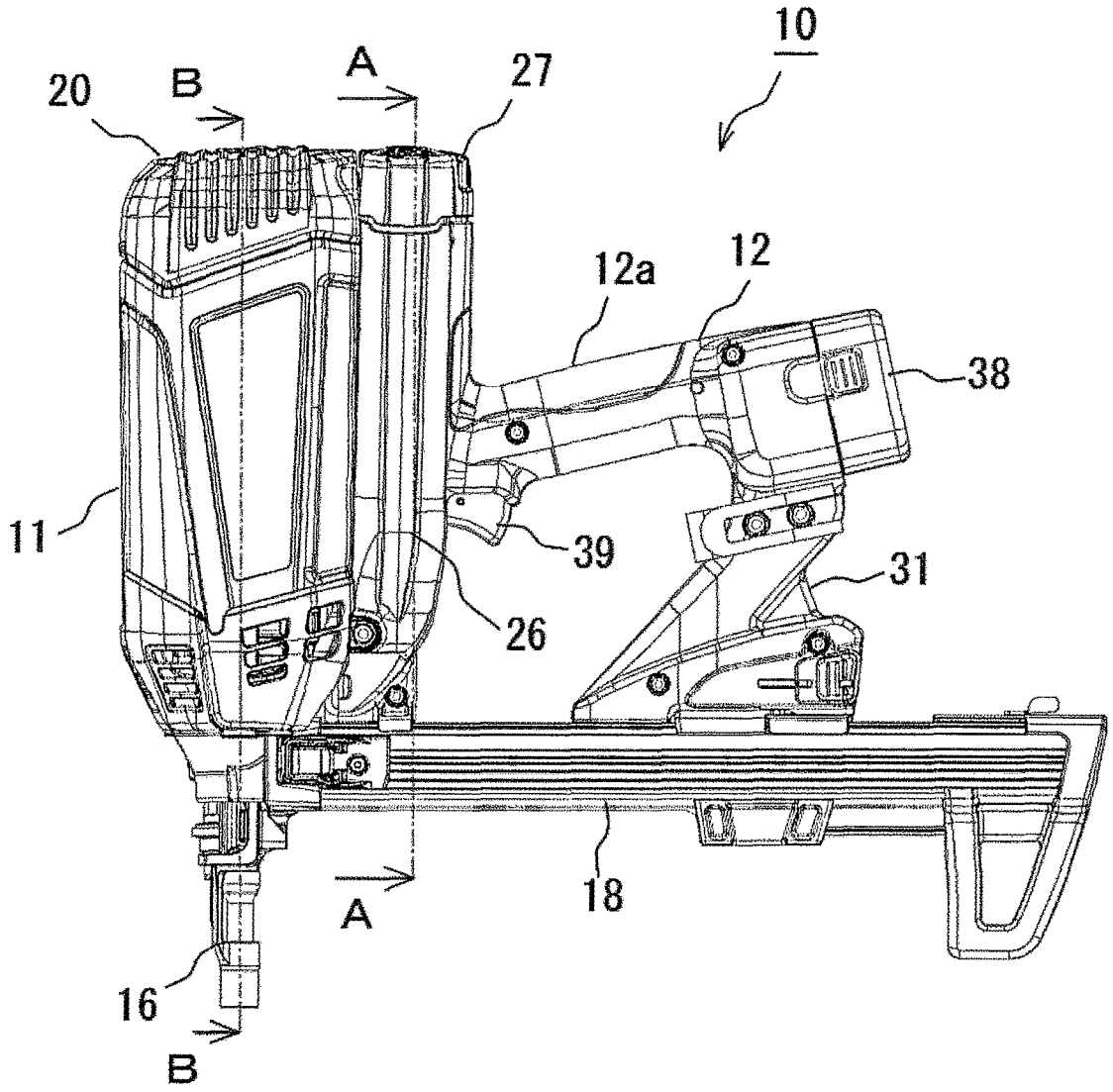
FIG. 1 is a side view of a gas combustion type driving tool.
Figure 2:
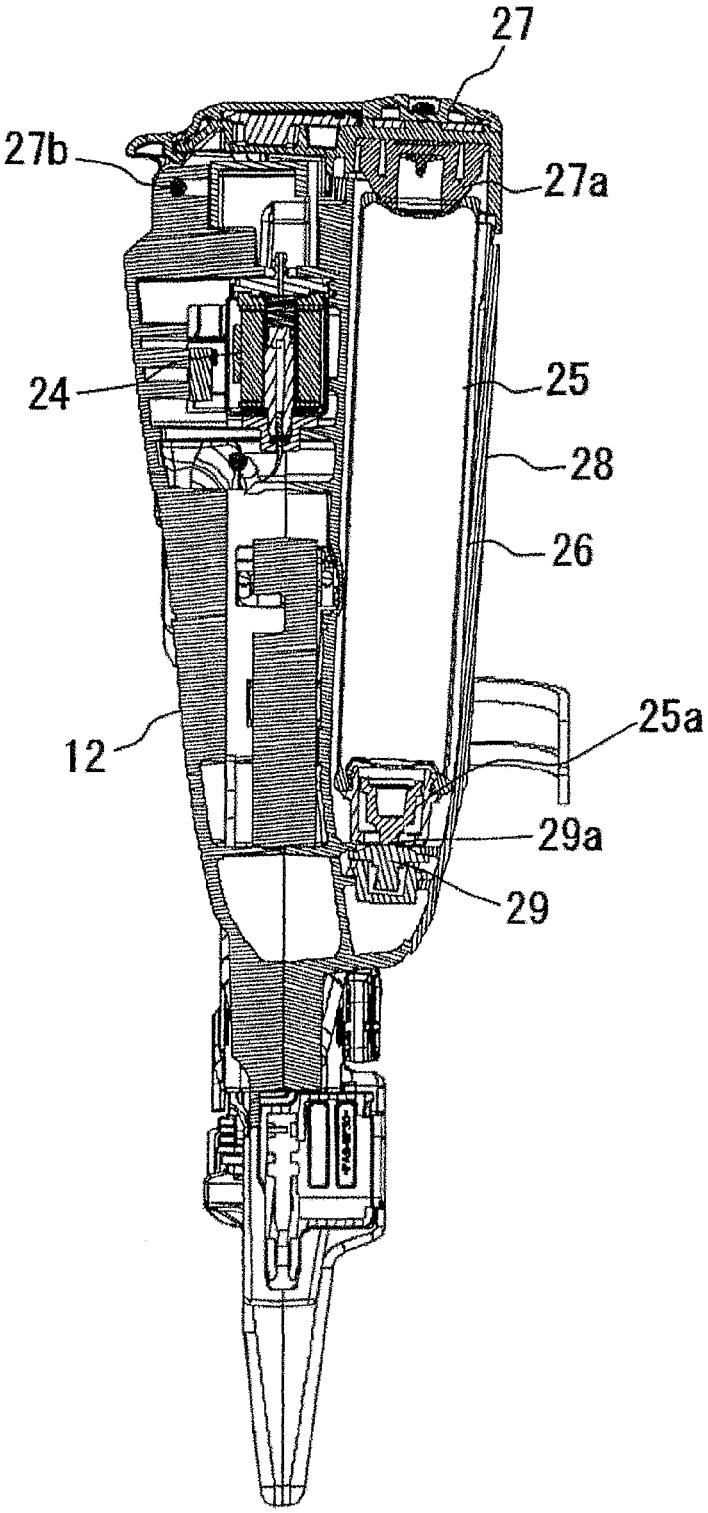
FIG. 2 is a longitudinal section view (A-A section view) of the gas combustion type driving tool.
Figure 3:
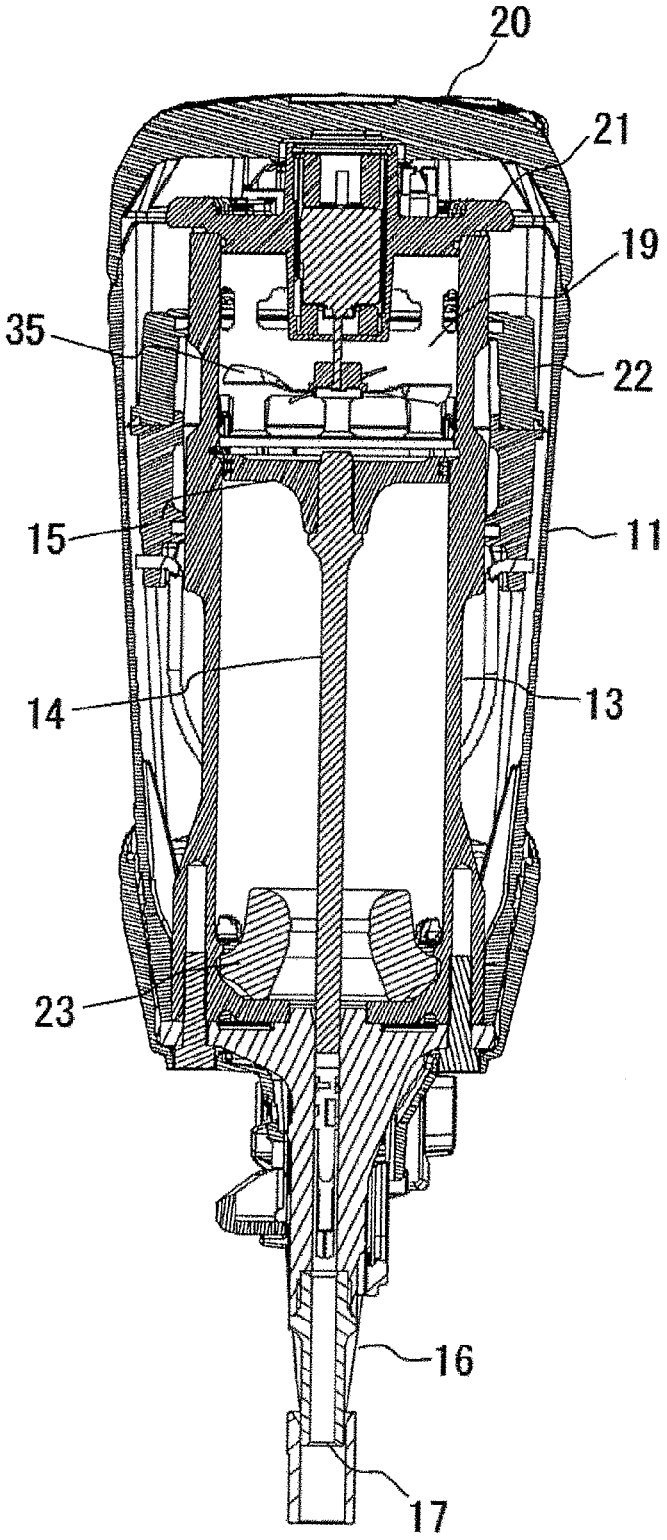
FIG. 3 is a longitudinal section view (B-B section view) of the gas combustion type driving tool.
Figure 4:
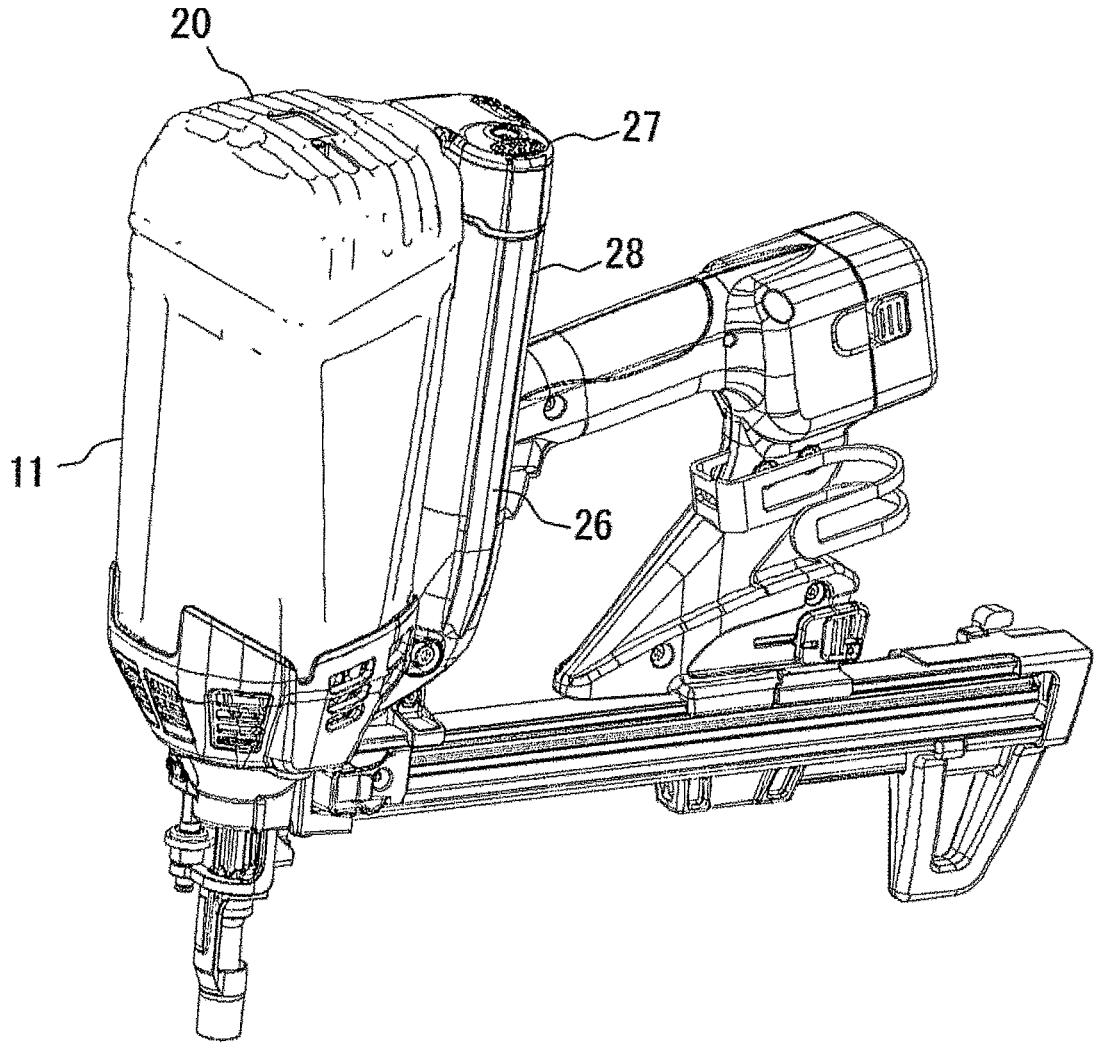
FIG. 4 is an external perspective view of the gas combustion type driving tool.

As shown in FIGS. 1 to 3, a gas combustion type driving tool 10 according to this embodiment includes a body housing 11 with a cylinder 13 stored therein, and a grip housing 12 disposed continuously backwardly of the body housing 11. A striking piston 15 is slidably stored within the cylinder 13, while a driver for driving a nail is connected to the lower surface side of the striking piston 15.

On the lower portion of the body housing 11, there is mounted a nose portion 16 for driving and guiding the nail toward a work-piece, while a driver 14 connected to the striking piston 15 is slidably stored in and can be guided by the nose portion 16. A magazine 18 storing a large number of nails therein is disposed laterally of the nose portion 16. When the nails within the magazine 18 are sequentially supplied to the nose portion 16 and are then driven by the driver 14, the nails are driven out from an injection port 17 formed in the leading end of the nose portion 16 into the work-piece.

Upwardly of the cylinder 13, there is formed a combustion chamber 19 where a flammable gas and the air can be mixed to generate a mixed gas and also the mixed gas can be burned. To form this combustion chamber 19, a movable sleeve 22 may be disposed such that it is slidable with respect to the cylinder 13. Specifically, the annular movable sleeve 22 is disposed to cover multiple openings formed in the upper portion of the side surface of the cylinder 13 to thereby form within the movable sleeve 22 a closed space communicating with the interior of the cylinder 13, and this closed space is used to form the combustion chamber 19. Here, when the nose portion 16 is pressed against the work-piece, the movable sleeve 22 can be slid upwardly to thereby close the combustion chamber 19.

Within the combustion chamber 19, the flammable gas and the air are mixed to generate the mixed gas. When this mixed gas is burned to generate a combustion gas and the pressure of the combustion gas is applied to the striking piston 15, the striking piston 15 can be driven up to a bumper 23 disposed at a bottom dead center portion within the cylinder 13.

In a cylinder head 21 for covering the upper end of the cylinder 13, there is formed a supply port (not shown) which faces the interior of the combustion chamber 19 and is used to supply the flammable gas into the combustion chamber 19. A gas supply pipe is connected to this supply port, whereby a gas fuel injected from an electromagnetic valve device 24 can be guided to the combustion chamber 19.

The electromagnetic valve device 24 is used to supply the gas fuel to the combustion chamber 19 and includes an electromagnetic valve for controlling the supply amount of the gas fuel. This electromagnetic valve device 24 is connected to a fuel container 25 filled with liquefied gas fuel. Thus, while measuring the fuel supplied from the fuel container 25, it can inject a given amount of flammable gas into the combustion chamber 19.

As the flammable gas is injected into the combustion chamber 19 by the electromagnetic valve device 24, a rotary fan 35 provided on the cylinder head 21 is rotated, whereby the flammable gas supplied into the combustion chamber 19 is mixed with the air existing within the combustion chamber 19 to thereby generate a mixed gas having a given air-fuel ratio.

Also, on the cylinder head 21, there is provided an ignition device (not shown) used to ignite the mixed gas generated within the combustion chamber 19 for combustion. This ignition device is constituted of an ordinary ignition plug which can raise the voltage of a battery 38 mounted on the rear end portion of a grip portion 12*a* up to a high voltage and can discharge this high voltage to thereby generate sparks. This ignition device can be actuated when a trigger 39 provided on the base portion of the grip portion 12*a* is operated. When the ignition device is actuated and the sparks are generated within the combustion chamber 19, a combustion gas of a high pressure is generated within the combustion chamber 19 and the impact of the combustion gas causes the striking piston 15 to slide, thereby driving a nail.

Here, the grip portion 12*a*, as shown in FIG. 1 and so on, extends in a direction substantially perpendicular to the axial direction of the combustion chamber 19 and thus, by gripping this grip portion 12*a*, an operator is able to hold the gas combustion type driving tool 10 stably.

Also, the fuel container 25 of this embodiment, as shown in FIG. 2, is formed to have a cylindrical shape. This cylindrical fuel container 25 is disposed on the outer peripheral portion of the combustion chamber 19 such that it extends substantially parallel to the axis of the combustion chamber 19.

The tubular fuel container 25 is stored in a fuel container storing portion 26 formed in the side surface of the grip housing 12. This fuel container storing portion 26, as shown in FIG. 2, is formed as a cylindrical space where the cylindrical fuel container 25 can be stored tightly.

Figure 5:
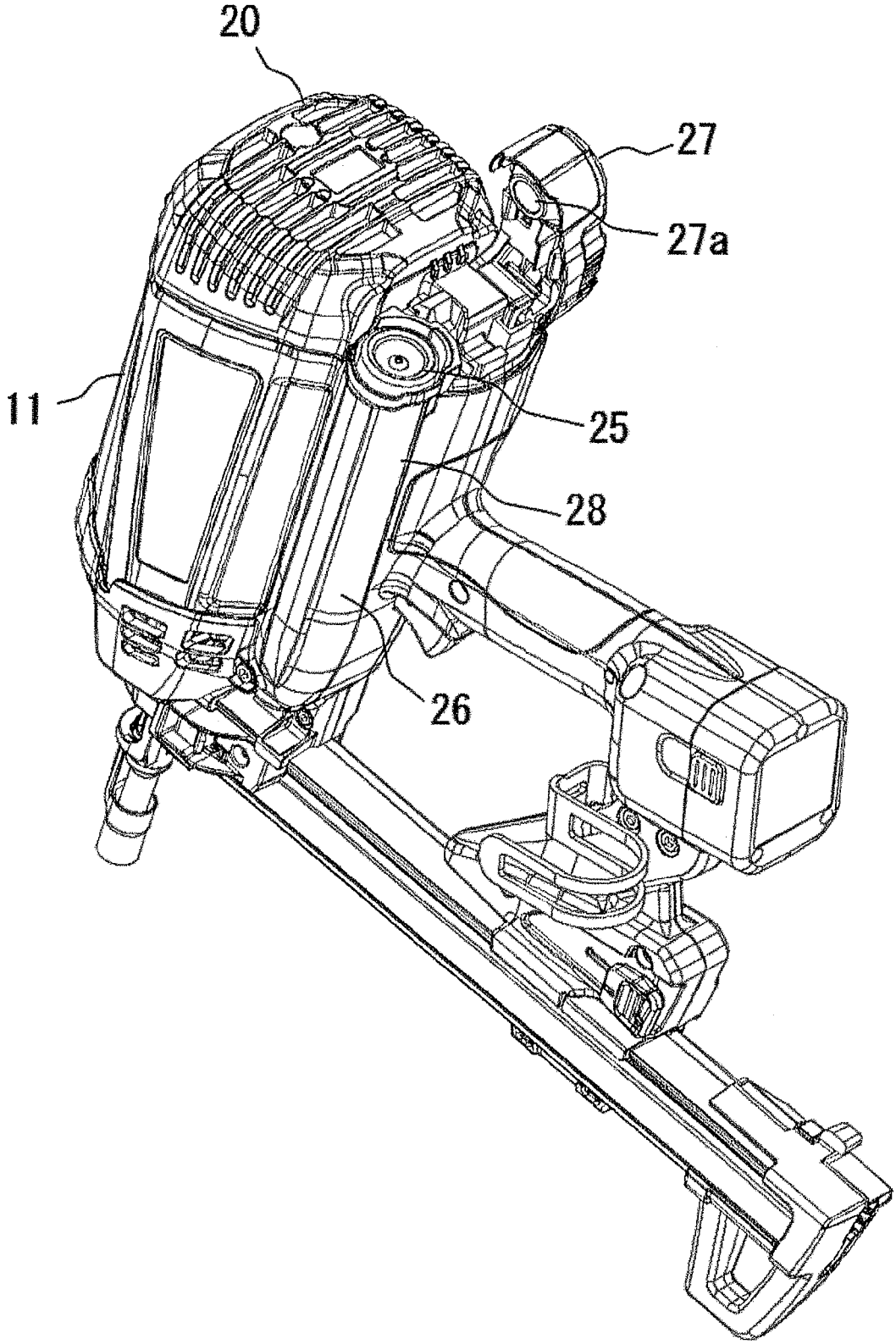
FIG. 5 is an external perspective view of the gas combustion type driving tool in a state where a lid is opened.

On the upper end of the fuel container storing portion 26, there is provided a lid 27 which can be opened and closed. The upper surface of the fuel container 25 stored in the fuel container storing portion 26 can be covered with the lid 27. The lid 27 is rotatably supported on the grip housing 12 through a lid hinge 27*b* and can be opened and closed in the longitudinal direction end portion of the fuel container storing portion 26. That is, as shown in FIG. 5, when the lid 27 is opened, the upper surface of the fuel container storing portion 26 is opened, whereby the fuel container 25 stored in the fuel container storing portion 26 can be taken out or the fuel container 25 can be stored into the fuel container storing portion 26.

Here, a pressure member 27*a* made of high polymer material such as rubber is fixed to the back surface of the lid 27. This pressure member 27*a*, when the lid 27 is closed, can press the fuel container 25 against a connecting section 29*a* which will be discussed later. Here, although the pressure member 27*a* may also be replaced with a metal-made spring or the like, an elastic member made of high polymer material can absorb impacts faster and thus can prevent a gas can or the like against damage when absorbing the impacts.

Also, on the side of the fuel container storing portion 26, as shown in FIG. 2, there is provided a cover member 28 which covers the side surface of the fuel container 25 stored in the fuel container storing portion 26. This cover member 28, as shown in FIG. 6, is fixed to the grip housing 12 by a bolt 30 and, when its fixed state by the bolt 30 is removed, it can be removed from the grip housing 12.

Figure 6:
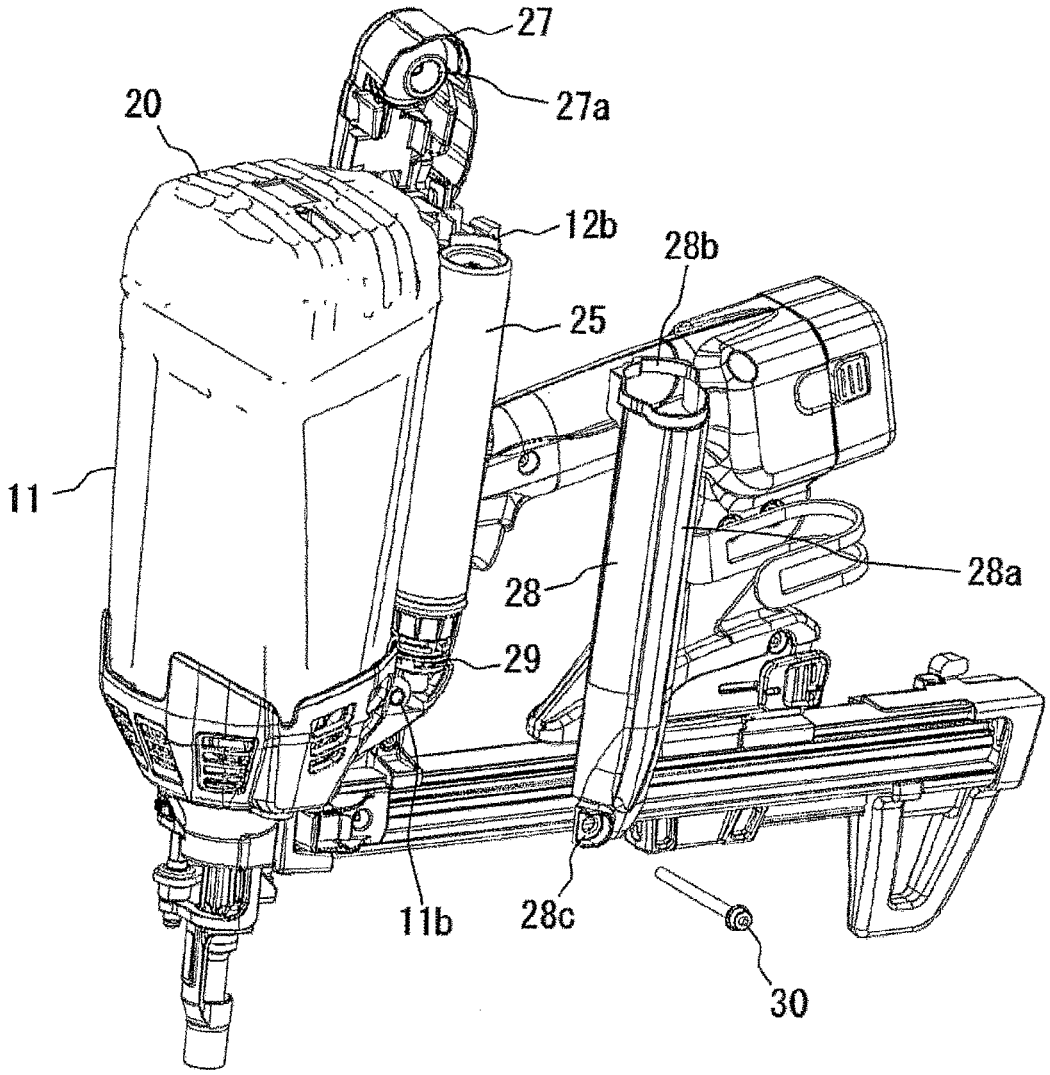
FIG. 6 is an external perspective view of the gas combustion type driving tool in a state where a cover member is removed.

Specifically, the cover member 28, as shown in FIG. 6, includes an engaging portion 28*b* formed in one end of its long and narrow semi-cylindrical portion 28*a*, and a bolt hole 28*c* formed in the other end thereof. To mount the cover member 28 onto the grip housing 12, with the engaging portion 28*b* caught on the engaged portion 12*b* of the grip housing 12, the bolt 30 may be inserted through the bolt hole 28*c* and then may be fastened and fixed to a bolt mounting portion 11*b*. Also, to remove the cover member 28 from the grip housing 12, the bolt 30 may be removed and the engaging portion 28*b* may be removed from the engaged portion 12*b*, whereby the cover member 28 can be removed easily.

Figure 7:
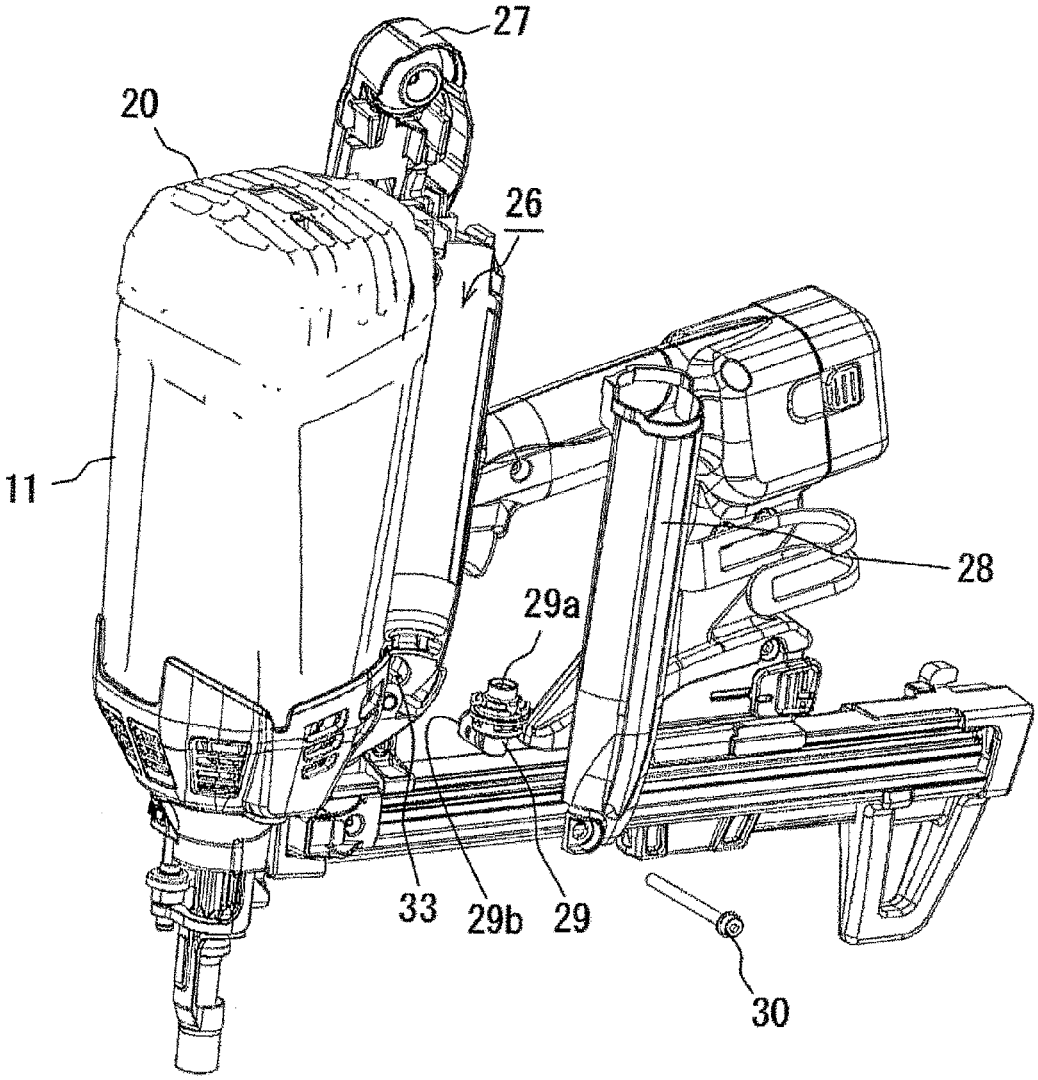
FIG. 7 is an external perspective view of the gas combustion type driving tool in a state where a connecting unit is removed.
Figure 8A:
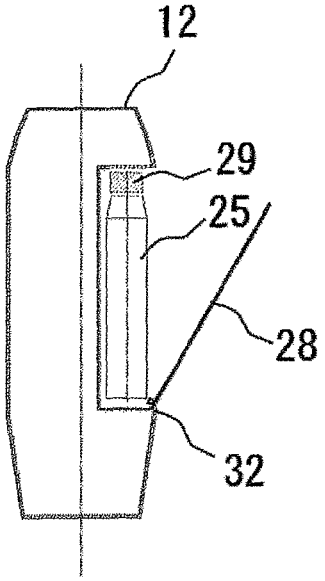
FIGS. 8(*a*) to 8(*d*) are views of a modification of the embodiment, showing a modification of a cover member mounting method (a first modification).
Figure 8B:
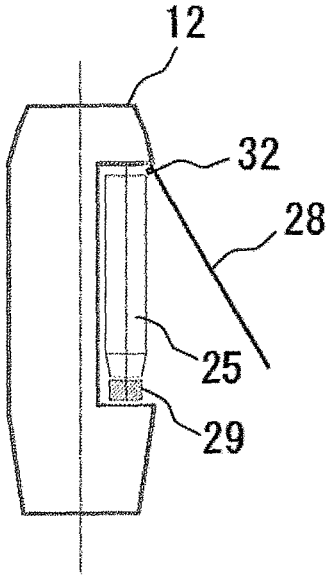
Figure 8C:
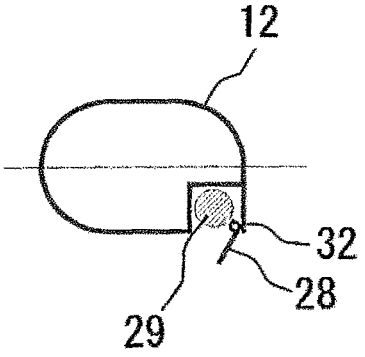
Figure 8D:
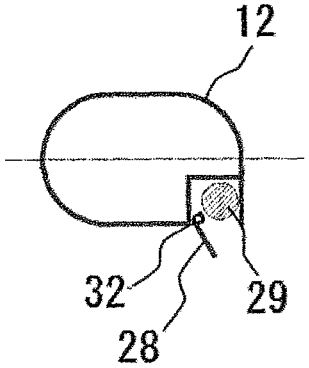

When the cover member 28 is removed in this manner, as shown in FIG. 7, the whole of the fuel container storing portion 26 is exposed. And, a connecting unit 29 provided in the deep portion of the fuel container storing portion 26 is exposed in such a manner that it can be maintained and also can be removed from the grip housing 12.

The connecting unit 29 includes a connecting section 29*a* for connecting the nozzle 25*a* of the fuel container 25, while it can be removably mounted on the grip housing 12. The connecting unit 29 includes therein a short pipe line and, in the opposite end to the connecting section 29*a*, an electromagnetic valve side connecting section 29*b*. This electromagnetic valve side connecting section 29*b* can be mounted into a connecting unit insertion port 33 formed in the grip housing 12 and thus can be connected to a gas pipe line disposed in the deep portion of the connecting unit insertion port 33. Thus, when the fuel container 25 is connected to the connecting section 29*a*, the fuel within the fuel container 25 can be supplied through the pipe line within the connecting unit 29, electromagnetic valve side connecting section 29*b* and gas pipe line within the grip housing 12 to an electromagnetic valve device 24.

Here, since the connecting unit 29 is simply fitted loosely into the connecting unit insertion port 33 formed in the grip housing 12, in the opened state of the cover member 28, the unit 29 is easy to slip off due to its own weight or the like. However, since the cover member 28 is provided, the unit 29 can be pressed against the inner surface of the cover member 28 and thus can be supported within the fuel container storing portion 26.

As described above, in accordance with the embodiment, a gas combustion type driving tool may include: a fuel container storing portion 26; a lid 27 that covers an opening of the fuel container storing portion 26; a connecting section 29*a* which is formed in the fuel container storing portion 26 and to which a nozzle 25*a* of a fuel container 25 is connected; and a cover member 28 that covers the connecting section 29*a*. The fuel container storing portion 26 may be adapted so that the fuel container 25 stored within the fuel container storing portion 26 is attachable and detachable by opening the lid 27. The connecting section 29*a* may be adapted to be exposed to an outside of the tool by opening the cover member 28.

According to this structure, by simply opening the cover member 28, the connecting section 29*a* can be cleaned or replaced, thereby being able to enhance the operation efficiency of the maintenance greatly. Also, to replace the fuel container 25, the lid 27 may be opened without opening the cover member 28, so that the connecting section 29*a* is not exposed. Due to this, a foreign substance is difficult to stick to the connecting section 29*a*.

In the above structure, the connecting section 29*a* may be formed in a connecting unit 29 which is adapted to be removable by opening the cover member 28.

According to this structure, by removing the connecting unit 29, the connecting section 29*a* can be cleaned or replaced further easily.

In the above structure, the connecting unit 29 may be supported within the fuel container storing portion 26 by the cover member 28.

According to this structure, the connecting unit 29 is easy to mount and remove.

In the above specific embodiment, the fuel container storing portion 26 is disposed in the side portion of the grip housing 12. However, this is not limitative but the fuel container storing portion 26 may also be disposed in other portions. For example, the fuel container storing portion 26 may be disposed in an interior of the grip portion 12*a*, or may be disposed along the magazine 18, or may be disposed within the interior of a bridge portion 31 interposed between the grip portion 12*a* and magazine 18.

Also, in the above specific embodiment, the cover member 28 is formed removably. However, this is not limitative. For example, as shown in FIGS. 8(*a*) to 8(*d*), the cover member 28 may be rotatably fixed to the grip housing 12 through a hinge 32 and may be opened and closed by rotating it. The hinge 32, as shown in FIGS. 8(*a*) and 8(*b*), may be provided on the longitudinal direction end portion of the grip housing 12, or, as shown in FIGS. 8(*c*) and 8(*d*), may be provided on the transverse direction end portion.

Figure 9A:
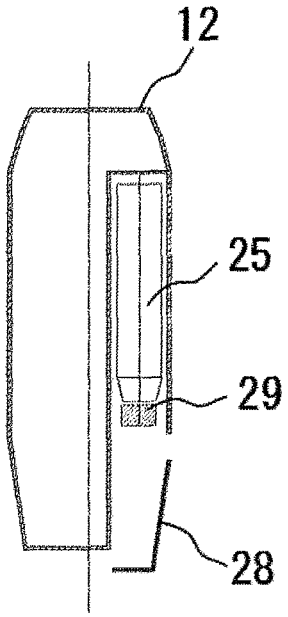
FIGS. 9(*a*) to 9(*c*) are views of a modification of the embodiment, showing a modification of a cover member mounting method (a second modification).
Figure 9B:
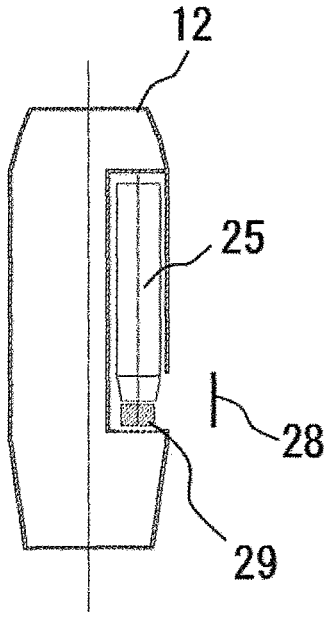
Figure 9C:
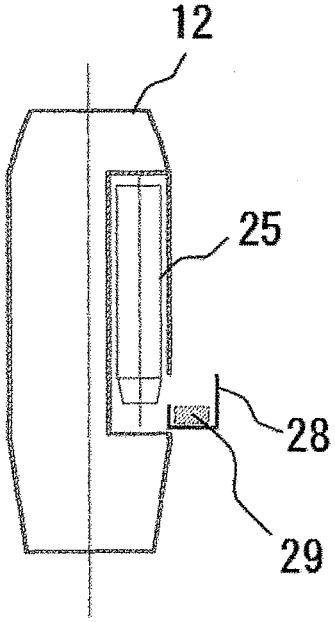

In the above specific embodiment, the whole of the side portion of the fuel container 25 is covered with the cover member 28. However, this is not limitative. For example, as shown in FIG. 9(*a*) to 9(*c*), there may be provided a cover member 28 which covers only the connecting unit 29 neighboring portion.

In the above modifications shown in FIGS. 8(*a*) to 8(*d*) and 9(*a*) to 9(*c*), the description and illustration of the lid 27 are omitted. However, the lid 27 may be disposed in a proper portion with design or the like taken into consideration. For example, the lid 27 can be structured to cover the longitudinal direction end portion of the fuel container 25.

In the above embodiment, the lid 27 and cover member 28 are structured as separate members. However, this is not limitative. The cover member 28 may also be structured to serve also as the lid 27. For example, with such structure as shown in FIGS. 8(*a*) to 8(*d*), by opening the cover member 28, the connecting section 29*a* can be exposed in a maintenance allowable manner and also the fuel container 25 can be mounted and removed.

DESCRIPTION OF REFERENCE NUMERALS AND SIGNS

10: Gas combustion type driving tool
11: Body housing
11*b*: Bolt mounting portion
12: Grip housing
12*a*: Grip portion
12*b*: Engaged portion
13: Cylinder
14: Driver
15: Striking piston
16: Nose portion
17: Injection port
18: Magazine
19: Combustion chamber
20: Cylinder cap
21: Cylinder head
22: Movable sleeve
23: Bumper
24: Electromagnetic valve device
25: Fuel container
25*a*: Nozzle
26: Fuel container storing portion
27: Lid
27*a*: Pressure member
27*b*: Lid hinge
28: Cover member
28*a*: Semi-cylindrical portion
28*b*: Engaging portion
28*c*: Bolt hole
29: Connecting unit
29*a*: Connecting section
29*b*: Electromagnetic valve side connecting section
30: Bolt
31: Bridge portion
32: Hinge
33: Connecting unit insertion port
35: Rotary fan
38: Battery
39: Trigger

What is claimed is:

1. A gas combustion type driving tool comprising:

a fuel container storing portion that includes an opening to store a fuel container;

a lid that covers the opening of the fuel container storing portion;

a connecting section which is formed in the fuel container storing portion and to which a nozzle of the fuel container is connected; and a cover member that exposes the connecting section to an outside of the tool by opening the cover member, that covers the connecting section by closing the cover member, and that is a separate member from the lid, wherein the fuel container storing portion is adapted so that the fuel container stored within the fuel container storing portion is attachable to and detachable from the connecting section by opening the lid only, without opening the cover member, wherein the connecting section is adapted to be exposed to an outside of the tool by opening the cover member only, without opening the lid, and is adapted to not be exposed to an outside of the tool by opening the lid only, without opening the cover member, wherein the connecting section is formed in a connecting unit which is adapted to be removable from the tool by opening the cover member, and wherein the connecting unit is a separate member from the cover member.

2. The gas combustion type driving tool according to claim 1, wherein the connecting unit is supported within the fuel container storing portion by the cover member.

* * * * *